United States Patent [19]

Lange et al.

[11] Patent Number: 4,971,303

[45] Date of Patent: Nov. 20, 1990

[54] PADDLE WHEEL DISTRIBUTOR SYSTEM FOR PRINTED PRODUCTS

[75] Inventors: Klaus-Ulrich Lange, Gersthofen; Reinhard Mayr, Augsburg, both of Fed. Rep. of Germany

[73] Assignee: Man Roland Druckmaschinen AG, Offenbach-am-Main, Fed. Rep. of Germany

[21] Appl. No.: 340,851

[22] Filed: Apr. 20, 1989

[30] Foreign Application Priority Data

Apr. 28, 1988 [DE] Fed. Rep. of Germany ..... 3814401

[51] Int. Cl.[5] ..... B65H 39/00

[52] U.S. Cl. ..... 270/60; 270/47; 271/187; 271/315

[58] Field of Search ..... 270/45, 47, 58, 60; 271/187, 279, 315, 309

[56] References Cited

U.S. PATENT DOCUMENTS 2,403,062 2/1946 Edwards ..... 271/315
4,834,361 5/1989 Fenske ..... 271/315

FOREIGN PATENT DOCUMENTS 3521471 4/1986 Fed. Rep. of Germany ..... 270/53
1230811 12/1986 Fed. Rep. of Germany .
482578 3/1938 United Kingdom .

OTHER PUBLICATIONS

"Atlas des Zeitungs-und Illustrationsdruckes"(Atlas of Newspaper and Magazine Printing) by A. Braun, Frankfurt a. M., FED. REP. GERMANY 1960, p. 70.

*Primary Examiner*—Edward K. Look
*Assistant Examiner*—Therese M. Newholm
*Attorney, Agent, or Firm*—Frishauf,Holtz,Goodman & Woodward

[57] ABSTRACT

To provide for gentle braking by braking fingers (12) located in axial slots between paddle wheel vanes or blades (9, 10) of paddle wheels (8), the fingers have an outer contour which is shaped and dimensioned, at least in the inlet region of gaps (11) for the printed product forming an intersection angle ($\alpha$) defined by the axial projection between the contour of the braking fingers and the adjacent inner surface (91) of a vane or blade to continuously increase during rotation of the paddle wheel vanes or disks, to thereby define effective gaps of continuously decreasing width during rotation of the paddle wheel vanes. Preferably, the position of the fingers is adjustable along a predetermined direction (X) by an electrical closed loop positioning system (13–20, 43), receiving input signals (44, 45) representative of thickness of products and machine speed and, preferably, also emergency control signals (48) to control the position of the fingers with respect to the vanes or blades. Emergency control signals cause withdrawal of the blades to a maximum effective gap position, for example upon tearing of supply belts; increased braking by the fingers, with a narrowed gap, at different axial positions can be used to overcome skew of incoming or delivered products.

16 Claims, 2 Drawing Sheets

PADDLE WHEEL DISTRIBUTOR SYSTEM FOR PRINTED PRODUCTS

FIELD OF THE INVENTION

The present invention relates to a paddle wheel distribution system for printed products, and more particularly to a paddle wheel or spider wheel distributor which includes a braking finger to reduce the speed of incoming products to the circumferential speed of the paddle wheel or spider wheel.

BACKGROUND

Paddle wheel or spider wheel distributors are known, see for example the referenced literature "Atlas des Zeitungs- und Illustrationsdruckes" ("Atlas of Newspaper and Magazine Printing") by A. Braun, Frankfurt a.M., Fed. Rep. Germany, 1960, page 70. The publication describes an arrangement in which folded printed products, derived from a folding flap cylinder, are delivered, for example by gravity, directly into gaps formed by spiral paddle or spider vanes. The paddle or spider vanes are constructed in the form of axially spaced disks, which, between adjacent disks, define axial slots. Resilient braking fingers or tongues are located in the axial slots between the paddle wheel disks. The fingers are so shaped and constructed that they, in projection, at least partially narrow or constrict the gaps between adjacent paddles or spider vanes of the wheels. Due to increased friction of the folded products between the inner contour of a paddle or spider vane and the braking tongue, the printed products are braked so that the lower circumferential speed of the paddle wheel or spider wheel cylinder can accept the printed products at the lower circumferential speed. This braking is rather abrupt; the abrupt braking of the printed products results in compression of the printed product, formation of waves, undulations, ridges or corrugations thereon, particularly at the leading edge or close to the leading edge of the folded product.

THE INVENTION

It is an object to improve a paddle wheel or spider wheel distributor system in such a manner that printed products, and especially folded printed products being delivered thereto can be braked and reduced in speed to be compatible with the circumferential speed of the distributor wheel without resulting in deformation of the sheets, or application of compressive forces thereagainst.

Briefly, the outer contour of the braking fingers is shaped and dimensioned, at least in the inlet region of the gaps formed between adjacent paddle wheel brakes, and in which the printed products are to be received, to define or form an intersection angle $\alpha$ continuously increasing during rotation of the paddle wheels or disks. Preferably, the intersection angle increases smoothly and gradually. The intersection angle $\alpha$ is herein defined as the axial projection between the contour of the braking finger and the adjacent inner surface of a vane or blade of the paddle or spider wheel.

The arrangement has the advantage that the intersection angle in the inlet region which continuously increases will provide a gentle and continuously variable braking of the printed product, typically the folded products.

Further, the position of the braking fingers can be changed by an automatic control system which positions the fingers in accordance with the thickness of products to be distributed. The control system can also be made responsive to monitoring signals detecting tear of a continuously fed web which, when folded, forms the folded products and/or skew of the products being supplied, or delivered.

DRAWINGS

FIG. 1 is a schematic axial cross-sectional view through a paddle wheel or spider wheel distributor and showing a braking finger, together with a shifting apparatus; and FIG. 2 shows the path of a folded printed product in various phases of movement of the paddle or spider wheel.

DETAILED DESCRIPTION

Figure 1:
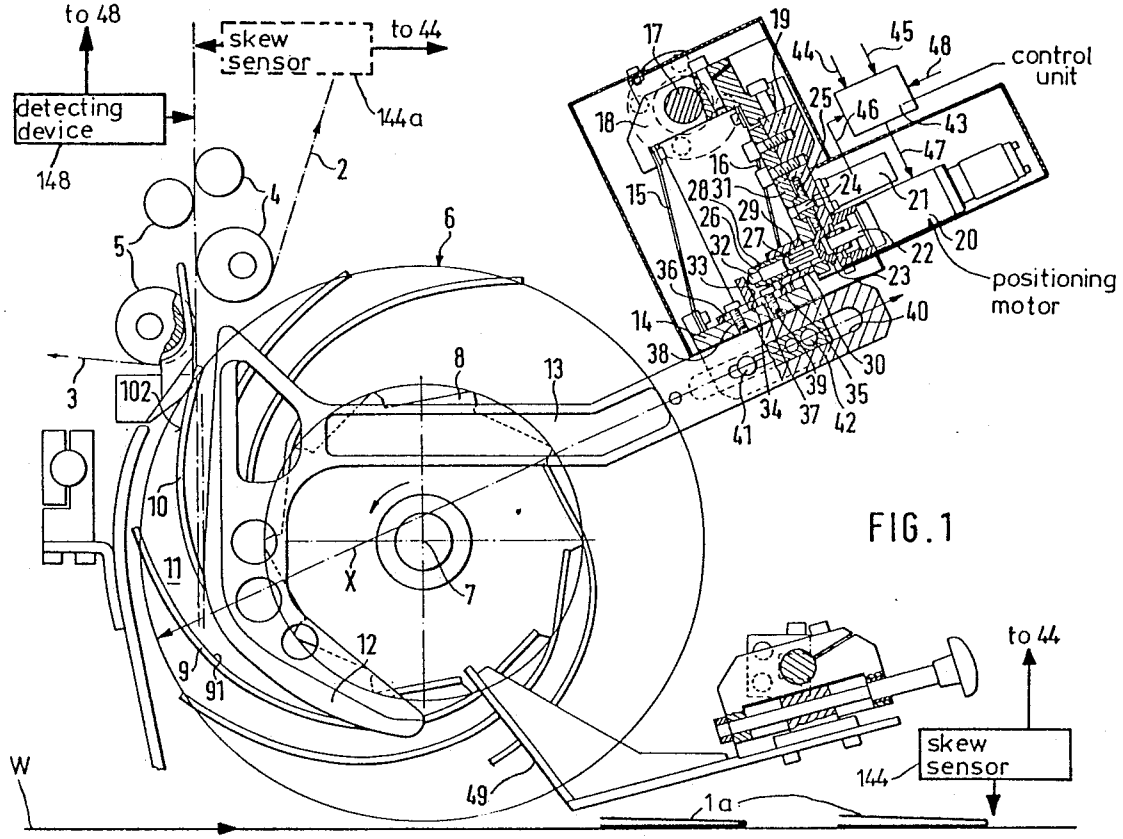

A folding flap cylinder, not shown in FIG. 1, delivers printed products 1 to a paddle or spider wheel distributor. Two belt systems 2, 3 with adjustable belt guiding rollers 4, 5 guide the folded products 1 (FIG. 2) to the paddle. The paddle wheel 6 has a shaft 7 and is formed of a plurality of axially spaced wheel disks 8, each one of which carries the same number of circumferentially uniformly distributed bent vanes 9, 10. The spacing between the respective disks defines slots therebetween. The inside 91 of a vane 9 and the outside 102 of the subsequent—in the direction of rotation—vane 10 defines a gap 11 which, due to the curvature of the vanes 9, 10, continuously decreases from outward towards the inside, or central region of the disk. The decrease is somewhat spiral. Braking fingers or tongues 12 are located in the slots between the vane disks 8. The braking fingers 12 are secured on the carrier arm 13 which can be shifted along a straight line X.

Shifting movement of the carrier arm 13, and hence of the finger 12, is obtained by a leaf spring parallelogram, having leaf springs 15, 16 secured to a support plate 14 which is attached to the rearward portion of the arm 13. The leaf springs 15, 16 are clamped to a clamping body 18 which, in turn, is secured to a support rod 17. The rod 17 is secured to a frame of the folding apparatus, not shown, and, therefore, is fixed in space.

The support plate 19 is secured to the clamping body 18, positioned perpendicularly to the shifting direction X of the carrier arm 13. An electrical positioning motor 20 is secured to the carrier plate 19 at the side remote from the braking finger 12. A positioning potentiometer 21, likewise, is secured to the plate 19.

A pinion 23 is secured to a drive shaft 22 of the motor 20. The drive shaft passes through the plate 19. A shaft 24 of the potentiometer 21 has a gear 25 located thereon, in engagement with the pinion 23, so that rotation of the motor 20 can be converted into an electrical signal.

A sleeve 26 is slidable on the shaft 22 of the positioning motor 20. The sleeve 26 is rotatably coupled to the drive shaft 22 by a spline spring 27.

Sleeve 26 is formed with an external thread 28 which is in engagement with an inner thread 29 on a bushing 30. The bushing 30 is connected to a plate 31 securely attached to the carrier plate 19.

A pressure bolt 32, having a hemispherical end surface, is secured to the sleeve 26 at the side remote from the motor 20. The hemispherical surface of the bolt 23 is engaged with a bent-over surface 33 of a pressure element 34. Pressure element 34, in cross section, is essentially T-shaped. A base plate 35 of the pressure element 34 is placed parallel to the shifting direction of the pressure element 34 and is formed with two elongated holes 36, 37, having their elongation extending in the direction of shift of the plate. Two screws 38, 39 located in the elongated holes 36, 37 clamp the pressure element 34 against the plate 14. Screws 38, 39 are secured to the plate 14. The pressure element 34, thus, is secured to the plate 14, even if the braking finger is completely withdrawn, so that the springs 15, 16 provide only enough remaining bias tension to ensure engagement of the angled surface 33 of the pressure element 34 on the hemispherical outer surface of the bolt 32.

The base position of the arm 13 can be adjusted with respect to the plate 14 by an elongated hole 40 located at the rearward end of the arm 13 and by clamping screws 41, 42, screwed into the plate 14. By loosening the screws 41, 42, the arm 13 can be shifted with respect to the plate 14, and again locked in position upon tightening of the screws.

OPERATIONS

Shifting of the arm 13, and hence of the braking finger 12, is caused by rotation of the positioning motor 20. Rotation of the drive motor 22 of the positioning motor 20 is transferred by the spline spring 27 on sleeve 26. Since the outer thread 28 on the sleeve 26 is in engagement with the inner thread 29 of sleeve or bushing 30, which sleeve or bushing 30 is fixed, rotary movement of the shaft of the motor is transferred into axial shift of the sleeve 26. Upon axial shift of the sleeve 26 in the shifting direction towards the paddle disks, pressure bolt 32 engages the surface 33 of the element 34. This, in turn, increases the tension of the springs 15, 16 which moves the braking finger 12 in a direction to narrow the gap 12. Upon rotation of the positioning motor 20 in reverse direction, sleeve (26) returns under spring pressure, since the energy stored in springs 15, 16 provides for re-setting of the braking finger. The surface 33 remains in continuous engagement with the bolt 32.

The leaf springs 15, 16 are oppositely bent over at their ends by the same angle, so that the shift of the arm 13 will always be parallel to the predetermined shift direction defined by the line X of FIG. 1. The leaf springs correspond to the inclined sides of the parallelogram.

The positioning motor 12 is controlled by an electrical control unit 43. The electrical control unit 43 receives various input signals, namely:

(1) input signals from line 44 representative of the thickness of the folded printed product 1, and forming a base value;

(2) a signal on line 45 representative of the speed n of the machine, which corresponds also to the rotary speed of the shaft 7;

(3) over input 46, an actual value of the position of the braking tongue 12, derived from the potentiometer 43.

The "thickness" input signals from line 44 as well as the "speed" signals of the machine are combined and, in accordance with the machine characteristics, a command or desired value for the position of the braking finger 12 is obtained thereby. This command value is compared with the actual position value derived from the potentiometer 21 and, if there is a difference, a suitable control output signal 47 is derived from the control unit 46 which is applied to the positioning motor 20 to correct any difference or deviation between the desired and commanded values.

In accordance with a preferred feature of the invention, two braking fingers 12 are located on individual and separate arms 13, and can be independently controlled by individual positioning motors 20. Each positioning motor is controlled by an individual control unit 43. The braking fingers, thus, will retard or decelerate printed products falling or fed into the paddle wheel distributor independently of each other at respective sides of the printed products. This system permits determination if an inclined position of the printed products is sensed at an output or delivery web, the respective control unit 43, or both of them, can be controlled to change the command or desired value, for example by modifying the base "thickness" value applied over line 44 to the respective control unit so that that one of the control units 43, which senses that the side of the front edge of the printed product which leads the other side, is braked more, to obtain straight and even distribution. Thus, printed products which are introduced into the paddle wheel already while skewed can be straightened by differentially applied braking at their leading edge by the respective braking finger 12. A skew sensor 144, scanning products 1*a* on transport web or belt W, can be easily constructed by providing, for example, two optical sensors in alignment with respective right and left side regions of the products 1*a* on the web or belt W, and comparing edge signals; if they arrive at the same time, the line is straight, if not, a skew has been detected and it is easily possibly to determine which side leads the other.

In accordance with a particularly preferred embodiment of the invention, further input values can be applied to the control unit 43. The control unit 43, which controls positioning of the braking fingers 12, then can be used to additionally affect the folded products in accordance with monitoring signals derived from the machine.

It is well known to provide web tension sensors in continuous web rotary printing machines, which sense if the tension of the web passing through the various rollers or cylinders is appropriate and, of course, can also determine if the web should tear. Such web tension sensors have been in public use for decades and are described in the literature, for example in British Pat. No. 482,578, published 1938, and also in German Pat. No. 1,230,811. Printing machines which handle paper webs which require folding are occasionally subject to malfunction. Paper jams or chokes may occur at or adjacent to the folding apparatus which may be a folding triangle, a folding cylinder, or the like. When a malfunction occurs, severe strains and possible damage to machine parts may occur. Before chokes occur, or at least before they become sufficiently developed to cause damage, conditions may warn of impending pile-up. For example, if the product is beginning to accumulate at a certain point, lack of a product being delivered is an indication of a product choke, for example of presence of a product on a folding apparatus at an improper time. The sequence of products can also be monitored, so that if they appear at improper intervals, a choke may be in the process of development and immediate action must be taken. Chokes become troublesome rapidly. Apparatus to anticipate a choke is also known, and described for example in the foregoing British Pat. No. 482,578. A particular point at which many chokes occur in printing machine is after severing of the web, and as the severed product is being folded on a folding cylinder. The products at this position occasionally accumulate, and choke subsequent mechanisms. At such times, the product is then not carried beyond the folding rollers and, in the present apparatus beyond the rollers 4, 5. Discrepancies or irregularities in operation, thus, can be determined when they occur and form indications of a choke being developed, or occurring shortly thereafter. Interruption of machine operation as soon as possible is desirable.

In accordance with a feature of the invention, a detecting device 148 is provided which detects, for example, absence of products or irregularity of feed of products. Such detecting devices may include well-known light-responsive electrical apparatus, such as photoelectric cells or the like. The output signals from such detecting devices are then applied to the input 48 of control unit 43. The detecting device 148, since known as such, is shown only schematically. It determines or senses if tension of supplied webs for printing suddenly drops, or absence or irregular feed of folded products.

The input 48 to the control unit 43 forms an emergency signal input. Malfunction will result in an emergency signal to input 48, and control unit 43 will immediately cause retraction or withdrawal of the braking finger or fingers 12. Thus, independently of the previously calculated and controlled dependence of the desired value of the position of FIG. 12, emergency withdrawal or withdrawal under emergency conditions will result. This has the highly advantageous effect that any remaining printed products which are still in the folding apparatus (not shown), for example upstream of the rollers 4, 5, are still fed into the belt system in advance of malfunction; they can fall or be delivered to the paddle wheel and be distributed by the paddle wheel, although without braking. This has the advantage that, if a sudden machine stop is commanded, for example due to web tear or folding apparatus malfunction, jamming together or choking of printed products still being fed, is effectively prevented.

Figure 2:
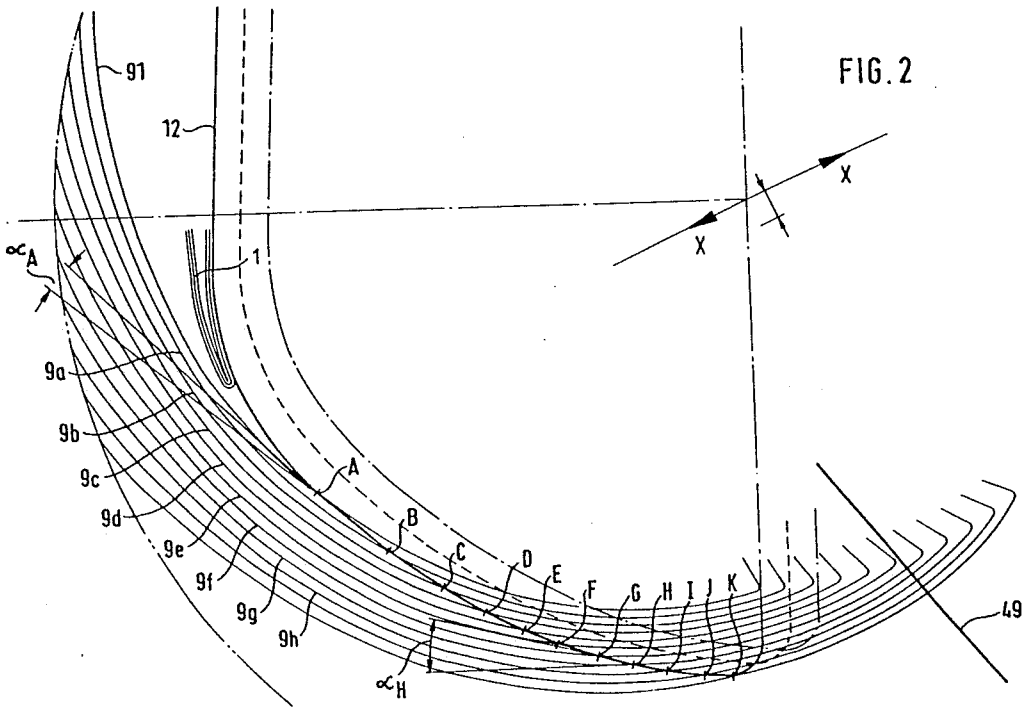

FIG. 2 illustrates the gentle braking of folded products 1 by the braking finger 12 in accordance with the present invention. A vane 9 is shown at positions 9*a* to 9*h*, as it rotates. The uniform spacing between the shown positions means that any one point on the deflection vanes 9 will have a constant circumferential speed. Due to the outer shape of the braking finger 12, the projected outer contour of the braking tongue, upon rotation of the vane 9, will form angles $\alpha_A$ to $\alpha_H$ between the inside 91 of the respective vane and the outside of the finger 12. These angles $\alpha_A$ to $\alpha_H$ increase smoothly and continuously. The intersection points between the inner and the outer contour are shown at respectively sequentially positioned operating positions of the vane 9, by A to H. The spacing between the intersection points A to H is uniform.

BRAKING OPERATIONS

The folded product 1 is continuously outwardly urged by the outer contour of the braking finger 12 between the points A and H. The path which the leading edge of the folded product 1 covers in uniform time intervals thus, smoothly and continuously, becomes smaller or shorter. In the region of the lower end of the braking tongue 12, between the points H to K, the paths between two adjacent points remain relatively constant. The folded product 1, in this range of rotation, is already braked to a small remanent speed difference and, then, can run with its leading edge against an ejection finger 49 (FIG. 1). Ejection finger 49 can be located in the slots between axially spaced disks 8, in fixed position, for example secured to the frame of the apparatus. Upon ejection, the printed product 1 drops on the delivery belt W and, with the subsequent folded products, forms a stream of imbricated or shingled products.

The control unit 43, coupled to the positioning motor 20, permits adjustment of the finger 12 with respect to the thickness of the folded products as well as the dynamic conditions of braking required and varying with machine speed. This arrangement permits compression-free and distortion-free braking of folded products over a wide operating range and a wide range of thicknesses and surface characteristics of printed products.

The width of the printed products being handled can be determined, readily, by placement of a respectively suitably selected number of vane disks 8 and braking tongues located therebetween. Thus, a basic modular structure of a few vane disks 8 can readily be expanded by adding additional modular structures, axially with respect thereto, so that printed products of any desired width can be distributed.

Various changes and modifications may be made within the scope of the inventive concept. For example, the skew sensor 144 can also be arranged to sense skew of incoming printed products 1 delivered by the belt system 2, 3, as shown schematically in broken lines by sensor 144*a*, or both sensors can be used.

We claim:

1. Paddle wheel distributor for printed products having a plurality of paddle wheel disks (8);

a common rotatable shaft (7) retaining said paddle wheel disks in axially spaced alignment, the axial spaces between said disks defining spacing slots, each paddle wheel disk having a plurality of paddle vanes or blades (9) circumferentially located thereabout and defining product receiving gaps (11) between adjacent blades, said gaps having an open inlet region for the products (1); and a plurality of non-rotating braking fingers (12) located in the spacing slots, said braking fingers having an outer contour on one side thereof which, in axial projection with respect to the gaps, covers said gaps at least within a predetermined angular range of the disks, wherein, in accordance with the invention, said outer contour of the braking fingers (12) is shaped and dimensioned at least in the inlet region towards said gaps (11) for the printed products to form an intersection angle ($\alpha$) which continuously increases during rotation of the paddle wheel or disk, for progressively braking printed products supplied to said paddle wheel disks upon entry into said gaps and then continuing as the leading edge of said printed products travels into said gaps, wherein said intersection angle ($\alpha$) is defined by the axial projection between the contour of the braking finger and the adjacent inner surface (91) of the vane or blade; and wherein the axial projection between the contour of the braking finger (12) and the adjacent inner surface of the vanes or blades (9) of the paddle wheels or disks (8) define effective gaps of continuously decreasing width during rotation of the paddle wheels or disks.

2. The distributor of claim 1, wherein said intersection angle ($\alpha$) increases smoothly and gradually as the vanes of the paddle wheels or disks rotate with respect to the braking fingers.

3. The distributor of claim 1, further including movable support means (13, 14, 15, 16) retaining said braking fingers (12) to vary, upon movement of said braking tongues, the width of the effective gaps.

4. The distributor of claim 3, wherein said movable support means control the width of the effective gaps in dependence on the thickness of the printed products.

5. The distributor of claim 3, including means (43) controlling said movable support means (13–16) for controlling the width of the gap (11) in dependence on speed of rotation of said disks (8).

6. The distributor of claim 3, further including control means (43) receiving a control input signal (44) representative of the width of the printed product and a further control input signal (45) representative of the speed of rotation of said disks (8); and wherein said control means control the position of said movable support means (13–16) to control the width of said effective gaps in dependence on the thickness of said printed products and machine speed.

7. The distributor of claim 3, further including a positioning motor (20) acting on said movable support means (13–16) for moving the movable support means and thereby shifting the position of the fingers (12).

8. The distributor of claim 7, further including control means (43) receiving a control input signal (44) representative of the width of the printed product and a further control input signal (45) representative of the speed of rotation of said disks (8);

wherein said control means control the position of said movable support means (13–16) to control the width of said effective gaps in dependence on the thickness of said printed products and machine speed; and wherein said control means (43) provides a positioning output for said electric positioning motor (20).

9. The distributor of claim 8, further including feedback signal supply means (23, 25, 21) coupled to said movable support means and providing an actual position signal representative of the position of the movable support means and hence of said fingers; and wherein said control means (43) receives said actual position signal (46) to provide for positioning of said fingers in a closed control loop.

10. The distributor of claim 3, wherein said movable support means comprises a support arm (13) and two parallel leaf springs (16, 17) coupled to said support arm for providing a parallelogram suspension for said support arm, and hence said fingers (12), for shifting said fingers in a predetermined shifting direction (X).

11. The distributor of claim 6, further including a detecting device (148) for sensing irregular transport of said products, said detecting device (148) providing a control signal to said control means (43) to control operation of said movable support means in a direction to enlarge said effective gaps.

12. The distributor of claim 6, further including an emergency signal input (48) coupled to said control means (43) and said detecting device (148) which, upon receiving from said detecting device an emergency signal, causes said movable support means to position the fingers (12) at a location of increased width of said effective gap.

13. The distributor of claim 1, wherein the paddle vanes or blades (9, 10) are essentially spirally curved.

14. The distributor of claim 6, wherein two braking fingers are provided, located at axially spaced positions with respect to said distributor, each braking finger having an individual movable support means (13–16), and an individual control means (43), and means (144, 144*a*) for sensing skewed position of said printed products engaged by the vanes, and controlling the respective braking fingers in a direction to align the products parallel to the axis of rotation of said shaft (7).

15. The distributor of claim 14, wherein the skew sensing means includes a skew sensor (144, 144*a*) positioned to sense alignment of the leading edge of a printed product (1) parallel to the axis of said shaft (7) and, if a skew is determined, controlling said control means to move that one of the fingers which is adjacent the leading side of the edge in a direction to narrow said effective gap to thereby provide for increased braking thereof and re-alignment of the printed product.

16. The distributor of claim 1, wherein said printed products comprise single or multiple folded products.

* * * * *